US007861803B2

(12) United States Patent
Gouws

(10) Patent No.: US 7,861,803 B2
(45) Date of Patent: Jan. 4, 2011

(54) AUXILIARY EQUIPMENT FOR USE WITH DRILLING APPARATUS

(76) Inventor: Petrus Christiaan Gouws, 6 Sliver Street, Bensleur, Witbank (ZA) 1035

( * ) Notice: Subject to any disclaimer, the term of this patent is extended or adjusted under 35 U.S.C. 154(b) by 0 days.

(21) Appl. No.: 12/297,921

(22) PCT Filed: Apr. 4, 2007

(86) PCT No.: PCT/IB2007/051200

§ 371 (c)(1),
(2), (4) Date: Feb. 27, 2009

(87) PCT Pub. No.: WO2007/122528

PCT Pub. Date: Nov. 1, 2007

(65) Prior Publication Data

US 2009/0308660 A1 Dec. 17, 2009

(30) Foreign Application Priority Data

Apr. 21, 2006 (ZA) ..... 2006/03216

(51) Int. Cl.
*E21B 21/01* (2006.01)

(52) U.S. Cl. ..... 175/209; 175/84; 175/210

(58) Field of Classification Search ..... 175/209, 175/57, 84, 207, 210
See application file for complete search history.

(56) References Cited

U.S. PATENT DOCUMENTS

| | | | | |
|---|---|---|---|---|
| 3,498,674 | A | 3/1970 | Matthews | |
| 3,800,890 | A | 4/1974 | Gyongyosi et al. | |
| 4,100,982 | A | 7/1978 | Wilkinson et al. | |
| 4,429,754 | A * | 2/1984 | Cormier | 175/88 |
| 4,440,243 | A * | 4/1984 | Howeth | 175/209 |

* cited by examiner

*Primary Examiner*—Hoang Dang
(74) *Attorney, Agent, or Firm*—Ladas & Parry LLP

(57) ABSTRACT

The invention relates to auxiliary working apparatus (10) for use with drilling apparatus for drilling holes into the ground and where the drilling apparatus has a platform supported by a support structure (50) thereof through which a drill bit (30) passes, the platform serving as a barrier between chippings blown from a hole being drilled into the ground and the drill motor and drill bit displacement mechanism of the drilling apparatus. The auxiliary working apparatus includes a roller-type brush (20) arrangement that, in its operative configuration, is mounted beneath the platform and that is operable for displacing chippings blown from a hole being drilled into the ground to spaced locations from the hole.

9 Claims, 2 Drawing Sheets

AUXILIARY EQUIPMENT FOR USE WITH DRILLING APPARATUS

Figure 1:
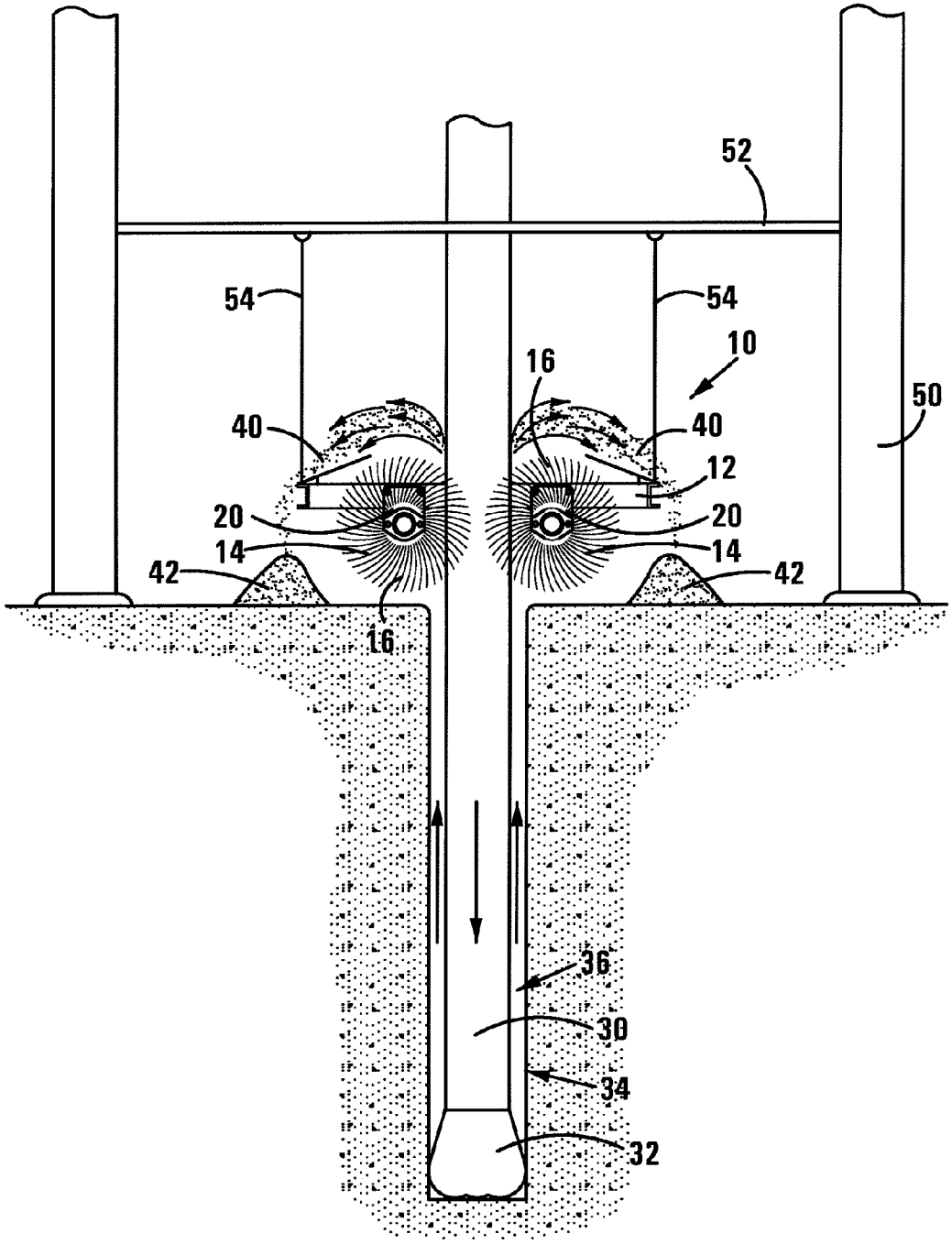

This invention relates to auxiliary equipment for use with drilling apparatus.

The auxiliary equipment as herein envisaged, hereinafter referred to specifically as an auxiliary working apparatus, is provided particularly for use with a drilling apparatus of the type that is used in mines, for drilling holes into the ground. Such a drilling apparatus generally includes a support structure, for the stable support of the apparatus in the region where drilling is required, a drill motor mounted on the support structure and a drill bit formed of a plurality of drill bit segments that is operatively connected to an output of the drill motor for the rotation thereof. Such a drilling apparatus includes also a displacement mechanism for displacing the drill motor and particularly the drill bit connected thereto along the axis of the drill bit, for drilling purposes, the drilling operation usually including the insertion of extension segments in line with the drill bit in order to permit drilling of "deep" holes. A drilling apparatus of the above type also includes a platform supported by the support structure at a spaced location above the ground in which a hole is to be drilled, the drill bit passing through a hole in the platform to permit the platform to effectively form a barrier between the operating parts of the drilling apparatus, i.e. the drill motor and the displacement mechanism, and the ground in which a hole is to be drilled.

The above construction is important because a drilling operation provides for the displacement of compressed air along a passage defined through the drill bit to the drilling segment that defines the drill bit head, this head defining a larger diameter than the remainder of the drill bit and thus providing for an annular space to be formed in the ground around the drill bit where it has drilled a hole into the ground. In addition to the compressed air fulfilling a cooling function, it serves also to displace soil displaced by the drilling operation, commonly and hereinafter referred to as chippings, from the ground through the annular space, the chippings effectively being "blown" from the annular space. As such, and without the platform being located as described, the chippings will blow directly onto the operating parts of the drilling apparatus referred to and this clearly will result in unnecessary wear and tear on these parts, as the chippings are very abrasive.

The continuous displacement of soil from a hole being drilled, as described, is important insofar as clogging of the annular space with chippings will otherwise result, thus causing resistance to the rotation of the drill bit and unnecessary strain on the drill motor. It has been found, however, that the chippings being "blown" from the annular space referred to, can also pass through the hole in the platform through which the drill bit extends, thus potentially defeating the objective of the platform, which is to protect the operating parts of the drilling apparatus from the chippings. Still further, chippings blown from the annular space will tend to gather on the ground immediately adjacent the hole being drilled and on the platform immediately adjacent the hole through which the drill bit extends, this gathering of the chippings resulting in "piles" of chippings being formed that will collapse from time to time and result in the chippings dropping back into the annular space. Clearly, for as long as air pressure is sufficient, these chippings will again be "blown" from the annular space, but particularly when air pressure is insufficient or becomes insufficient due to the depth of the hole being drilled, the chippings dropping back into the annular space will result in this space becoming clogged, resulting in interference with the rotation of the drill bit and unnecessary load being placed on the associated drill motor. In order to avoid motor damage, it is then required to reverse the direction of drill bit displacement and then again to provide for forward displacement, which can result in the chippings being released and again being blown from the annular space. This clearly will render a drilling operation time inefficient.

It is thus an object of this invention to at least alleviate the above known problems that are associated with the use of a drilling apparatus of the type herein envisaged.

Insofar as the auxiliary working apparatus of the present invention applies particularly in relation to the use of a drilling apparatus of the type envisaged above, any reference hereinafter to a drilling apparatus must be interpreted as a reference to drilling apparatus particularly of the type hereinabove described.

According to the invention there is provided an auxiliary working apparatus for use with drilling apparatus for drilling holes into the ground and which includes a support structure for supporting the drilling apparatus on the ground, a platform supported by the support structure in a configuration in which it forms a barrier at a spaced location above the ground on which the support structure is operatively positioned, a drill motor and a drill bit displacement mechanism supported by the support structure operatively above the platform and a drill bit operatively connected to the drill motor and extending through a hole in the platform to be displaced into the ground in which a hole is to be drilled, the auxiliary working apparatus including, in its operative configuration with respect to such a drilling apparatus, an auxiliary support structure supported by the support structure of the drilling apparatus operatively beneath the platform of the drilling apparatus;

displacement means mounted on the auxiliary support structure in a configuration in which it is operable for displacing chippings displaced from a hole being drilled to a location spaced from the hole; and operating means for operating the displacement means.

The displacement means of the auxiliary working apparatus may be at least one roller-type brush that is rotatably supported on the auxiliary support structure in a location in which, through its rotation, it can trap and displace chippings blown from the ground during drilling of a hole to a location on the ground spaced from the hole.

According to a preferred embodiment of an auxiliary working apparatus of the invention, the displacement means includes a pair of substantially parallel disposed roller-type brushes mounted on the auxiliary support structure in a configuration in which they are operatively located on opposite sides of the drill bit of the drilling apparatus, the brushes having bristles that surround the drill bit during rotation of the brushes for trapping and displacing chippings.

For the above embodiment of the apparatus of the invention, the roller-type brushes of the pair of roller-type brushes may be operatively connected to the operating means for rotation thereof in opposite directions and with their bristles, in the region where chippings are blown from a hole being drilled in the ground, moving in the same direction as the chippings, providing for the chippings to be trapped within the bristles of the brushes and then to be "thrown" away from the hole by centrifugal forces acting on the chippings, to a location spaced from the hole. As such, for each roller-type brush, a separator plate may be supported on the auxiliary support structure in a position with respect to the bristles of the brush for separating chippings trapped within the bristles of the brush during rotation of the brush and for guiding the chippings to be collected in a pile in a location spaced from a hole being drilled.

Clearly, various different brush arrangements and, particularly, roller-type brush arrangements can be envisaged for performing the function of the displacement means of the auxiliary working apparatus as herein envisaged. Also, the displacement means of the auxiliary working apparatus, instead of a brush or brush arrangement, may include at least one of a scraper blade, a vane, or the like, that is displaceable for displacing chippings away from a hole being drilled in the ground.

The auxiliary support structure of the auxiliary working apparatus of the invention particularly comprises a structure that can support the displacement means in its required operative configuration with respect to a drill bit and a hole being drilled by the drill bit, in use of the drilling apparatus with which the auxiliary working apparatus is operatively used. Particularly for the support of the auxiliary support structure of the auxiliary working apparatus by the support structure of the associated drilling apparatus, the auxiliary working apparatus may include a set of elongate flexible elements which operatively support the auxiliary support structure in a suspended configuration from the support structure of the drilling apparatus. Such support can be conveniently provided for by a set of chains or cables, while it is envisaged also that this support can be provided for in many different configurations.

The operating means of the auxiliary working apparatus may include a coupling arrangement for coupling the displacement means to a power output associated with the drilling apparatus. Alternatively, the operating means may include a drive means operatively connected to the displacement means for operating the displacement means. Particularly for an auxiliary working apparatus including a displacement means in the form of a pair of roller-type brushes, the operating means may include at least one hydraulic motor that can be driven by a hydraulic power supply and that is operatively connected to the pair of roller-type brushes for rotating the brushes. Clearly, the configuration of the operating means is greatly variable, being determined particularly by the mode of operation of the displacement means which is to be operated thereby.

The auxiliary working apparatus of the invention may comprise apparatus that is particularly adapted for use with a drilling apparatus for drilling holes into the ground, effectively serving as a dedicated chippings displacement apparatus for this purpose.

It is envisaged still further that the auxiliary working apparatus of the invention can be provided as part of a drilling apparatus and, as such, the invention extends also to such a drilling apparatus which includes an auxiliary working apparatus, in accordance with the invention, as part thereof.

Figure 2:
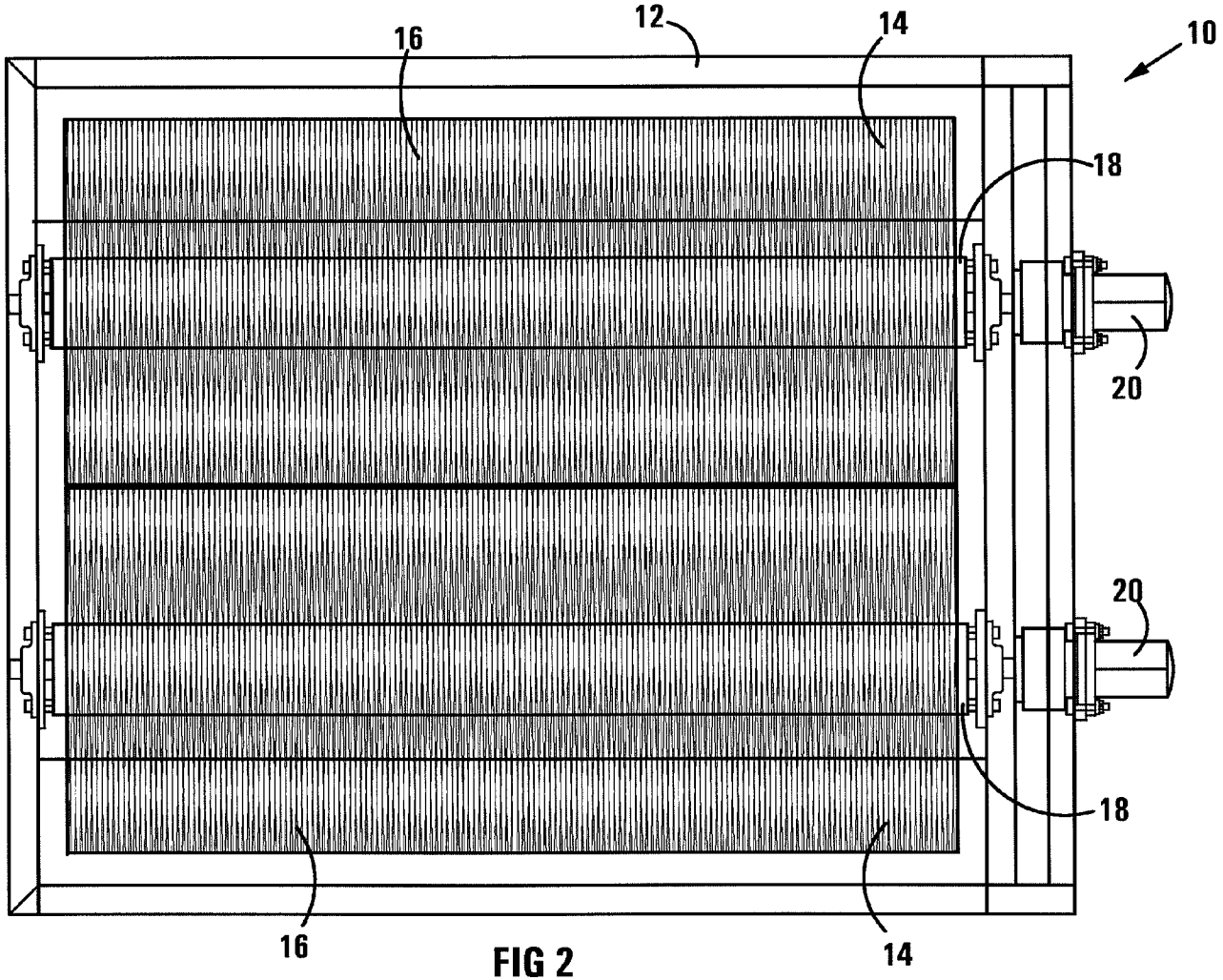

Further features of the auxiliary working apparatus of the invention and the operation thereof are described in more detail hereinafter with reference to an example of such an apparatus, which is illustrated in the accompanying diagrammatic drawings. In the drawings:

FIG. 1 illustrates schematically in side view the configuration and the operation of an auxiliary working apparatus for use with a drilling apparatus for drilling holes into the ground, in accordance with the invention; and FIG. 2 illustrates schematically in plan view and on a larger scale, the auxiliary working apparatus of FIG. 1.

Referring to the drawings, an auxiliary working apparatus for use with a drilling apparatus for drilling holes into the ground, in accordance with the invention, is designated generally by the reference numeral 10. The auxiliary working apparatus 10 includes an auxiliary support structure which includes a substantially rectangular support frame 12, the support frame 12 having displacement means in the form of a pair of roller-type brushes 14 rotatably mounted thereon in a parallel adjacent configuration with respect to one another.

Each brush 14 has relatively long bristles 16 secured to and extending from a support shaft 18, the free ends of the bristles 16, during rotation of the brushes 14 in use of the apparatus 10, just missing one another, as is clearly illustrated in both FIGS. 1 and 2 of the drawings. Each shaft 18 is operatively connected to a hydraulic motor 20 which can be driven by a compressed liquid supply, to provide for the rotation of the shafts 18 and, as such, the brushes 14. Insofar as the apparatus 10 is to be used in association with a drilling apparatus for drilling holes into the ground in a mining environment, the compressed liquid supply for driving the motors will be the same supply that is provided for the operation of the drilling apparatus.

It will be understood that the exact configuration of the auxiliary working apparatus as described, as well as the configuration specifically of the brushes, are greatly variable and, as such, these aspects are not described in any further detail herein.

FIG. 1 particularly illustrates the operative configuration of the auxiliary working apparatus 10 with respect to a drilling apparatus, the drilling apparatus including a support structure 50 whereby the drilling apparatus is stably supported in the vicinity where a hole in the ground is to be drilled, The frame 12 of the auxiliary working apparatus 10 is operatively suspended from the support structure 50, beneath the platform 52 of the support structure, e.g. by means of cables 54 (only partially shown). As such, the auxiliary working apparatus is located beneath the platform of the drilling apparatus and above the level of the ground in which a hole is to be drilled. The location of the apparatus 10 particularly is such that the drill bit of the drilling apparatus passes centrally between the brushes 14, this configuration being illustrated clearly in FIG. 1, where the drill bit of a drilling apparatus is designated by the numeral 30. The drill bit particularly is of a type that has a drilling head 32 having a diameter larger than the diameter of the remainder of the drill bit segments forming the drill bit, a hole 34 being drilled thus having a diameter that coincides with the diameter of the drill bit head. As such, an annular space 36 is defined between the drill bit and the surrounding face of the hole being drilled. With the drill bit particularly being of the type that has a central axial passage passing therethrough, through which compressed air is displaced towards the drill bit head 32, this compressed air will be displaced upwardly from the drill bit head 32 through the annular space 36, as indicated by the arrows, for displacing chippings resulting from drilling from the hole. The compressed air clearly also fulfils a cooling function in relation to the drill bit head.

During use of the auxiliary working apparatus 10 and of the associated drilling apparatus, the brushes 14 of the apparatus 10 will rotate in opposite directions with the bristles 16, in the region where the drill bit passes between the brushes 14, moving in the same directly as the chippings, i.e. operatively upwardly. The bristles 16 of the brushes 14 will thereby trap the chippings between them and displace the chippings operatively outwardly, i.e. as a result of the centrifugal forces acting thereon, effectively throwing the chippings outwardly to a location where the chippings are collected in spaced locations from the hole 34 being drilled. Each brush 14 also is associated with a separator plate 40 which is mounted on the support frame 12 and which is disposed with respect to the bristles 16 of the respective brushes to ensure the separation of the chippings from the brushes, serving also to guide the chippings towards the piles 42 that will be formed by the separated chippings in locations typically as illustrated.

It will be understood that the auxiliary working apparatus 10 as described, in addition to displacing chippings to a spaced location from the hole being drilled, will also prevent chippings from being blown through the hole in the platform 52 of the drilling apparatus. This ensures that chippings do not enter the region of the drilling apparatus where the working parts thereof operate and thus protects these working parts against wear and tear that could otherwise result from being exposed to the abrasive qualities of chippings.

The fact that the chippings are displaced to a spaced location from the hole being drilled ensures that these chippings cannot again drop into the hole, this being a problem commonly associated with the drilling of holes in environments as envisaged and resulting in clogging of holes with chippings, particularly where the pressure of the compressed air provided to blow the chippings from the annular space defined is no longer sufficient, which can particularly occur also where very deep holes are drilled. By preventing such clogging, unnecessary loads on the drill motor is avoided, while the release of chippings from within the annular space, which would otherwise be required and which is associated with momentarily reversing the displacement of the drill bit, also will not be required. This will ensure time efficiency associated with the drilling of holes which, without the auxiliary working apparatus, often is negatively affected.

It will be understood that the auxiliary working apparatus 10 can be provided as a dedicated unit, i.e. a chipping displacement apparatus and that the apparatus either can be separately provided or provided as part of a drilling apparatus. When provided as part of a drilling apparatus, the invention extends clearly also to such a drilling apparatus which includes auxiliary working apparatus as described as part thereof.

The invention claimed is:

1. An auxiliary working apparatus for use with a drilling apparatus for drilling holes into the ground and which includes a support structure for supporting the drilling apparatus on the ground, a platform supported by the support structure in a configuration in which it forms a barrier at a spaced location above the ground on which the support structure is operatively positioned, a drill motor and a drill bit displacement mechanism supported by the support structure operatively above the platform and a drill bit operatively connected to the drill motor and extending through a hole in the platform to be displaced into the ground in which a hole is to be drilled, the auxiliary working apparatus including, in its operative configuration with respect to such a drilling apparatus, an auxiliary support structure supported by the support structure of the drilling apparatus operatively beneath the platform of the drilling apparatus;

displacement means mounted on the auxiliary support structure in a configuration in which it is operable for displacing chippings displaced from a hole being drilled to a location spaced from the hole; and operating means for operating the displacement means;

wherein the displacement means is at least one roller-type brush that is rotatably supported on the auxiliary support structure in a location in which, through its rotation, it can trap and displace chippings blown from the ground during drilling of a hole to a location on the ground spaced from the hole.

2. An auxiliary working apparatus as claimed in claim 1, in which the displacement means includes a pair of substantially parallel disposed roller-type brushes mounted on the auxiliary support structure in a configuration in which they are operatively located on opposite sides of the drill bit of the drilling apparatus, the brushes having bristles that surround the drill bit during rotation of the brushes for trapping and displacing chippings.

3. An auxiliary working apparatus as claimed in claim 2, in which the roller-type brushes of the pair of roller-type brushes are operatively connected to the operating means for rotation thereof in opposite directions and with their bristles, in the region where chippings are blown from a hole being drilled in the ground, moving in the same direction as the chippings, providing for the chippings to be trapped within the bristles of the brushes and then being "thrown" away from the hole by centrifugal forces acting on the chippings, to a location spaced from the hole.

4. An auxiliary working apparatus as claimed in claim 3, which includes, for each roller-type brush, a separator plate supported on the auxiliary support structure in a position with respect to the bristles of the brush for separating chippings trapped within the bristles of the brush during rotation of the brush and for guiding the chippings to be collected in a pile in a location spaced from a hole being drilled.

5. An auxiliary working apparatus as claimed claim 1, which include a set of elongate flexible elements which operatively support the auxiliary support structure in a suspended configuration from the support structure of the drilling apparatus.

6. An auxiliary working apparatus as claimed in claim 1, in which the operating means includes a coupling arrangement for coupling the displacement means to a power output associated with the drilling apparatus.

7. An auxiliary working apparatus as claimed in claim 1, in which the operating means includes a drive means operatively connected to the displacement means for operating the displacement means.

8. An auxiliary working apparatus as claimed in claim 2, in which the operating means includes at least one hydraulic motor that can be driven by a hydraulic power supply and that is operatively connected to the pair of roller-type brushes for rotating the brushes.

9. A drilling apparatus for drilling holes into the ground and which includes an auxiliary working apparatus, as claimed in claim 1, as part thereof.

* * * * *